US009394927B2

(12) United States Patent
Yi et al.

(10) Patent No.: US 9,394,927 B2
(45) Date of Patent: Jul. 19, 2016

(54) HYDRAULIC OIL CYLINDER AND RELATED EQUIPMENTS, HYDRAULIC BUFFER SYSTEM, EXCAVATOR AND CONCRETE PUMP TRUCK

(75) Inventors: Xiaogang Yi, Changsha (CN); Yongdong Liu, Changsha (CN); Bingbing Chen, Changsha (CN)

(73) Assignees: Hunan Sany Intelligent Control Equipment Co., Ltd., Changsha (CN); Sany Heavy Industry Co., Ltd., Changsha (CN)

( * ) Notice: Subject to any disclaimer, the term of this patent is extended or adjusted under 35 U.S.C. 154(b) by 743 days.

(21) Appl. No.: 13/811,244

(22) PCT Filed: Jun. 21, 2011

(86) PCT No.: PCT/CN2011/076024

§ 371 (c)(1), (2), (4) Date: Apr. 2, 2013

(87) PCT Pub. No.: WO2012/010031

PCT Pub. Date: Jan. 26, 2012

(65) Prior Publication Data

US 2013/0199367 A1 Aug. 8, 2013

(30) Foreign Application Priority Data

Jul. 23, 2010 (CN) ..... 2010 1 0235136

(51) Int. Cl.
*F15B 15/20* (2006.01)
*F15B 15/22* (2006.01)

(52) U.S. Cl.
CPC ..... *F15B 15/20* (2013.01); *F15B 15/222* (2013.01)

(58) Field of Classification Search
CPC ..... F15B 15/22; F15B 15/221; F15B 15/222
USPC ..... 91/404, 405, 143; 92/85 R, 256; 403/318
See application file for complete search history.

(56) References Cited

U.S. PATENT DOCUMENTS 3,165,032 A * 1/1965 Konkle ..... F16J 1/006 277/434
2003/0140781 A1* 7/2003 Weiss ..... F15B 15/223 92/85 B
2010/0300283 A1* 12/2010 Imamura ..... F15B 15/222 92/85 R

FOREIGN PATENT DOCUMENTS

CN 1896552 A 1/2007
CN 2900888 Y 5/2007

(Continued)

*Primary Examiner* — Nathaniel Wiehe
*Assistant Examiner* — Matthew Wiblin
(74) *Attorney, Agent, or Firm* — Bret E. Field; Bozicevic, Field & Francis LLP

(57) ABSTRACT

A hydraulic oil cylinder has a buffer sleeve (4), a rodless cavity sealing end face (1-2) and at least one throttle oil channel (3-1). The buffer sleeve (4) is sleeved on an additional section (3*a*) of a piston rod in the rodless cavity (2-2) and axially slidable along the additional section (3*a*) of the piston rod. The rodless cavity sealing end face (1-2) is provided in an oil cylinder cavity between a rodless cavity oil passing hole (1-1) and the termination of the rodless cavity end face of the piston for the retraction process of the piston rod (3), and enables to block the buffer sleeve (4) and attach to the first end surface (4-1) of the buffer sleeve thereby forming a sealing surface.

14 Claims, 4 Drawing Sheets

(56) References Cited

FOREIGN PATENT DOCUMENTS

| | | | | | |
|---|---|---|---|---|---|
| CN | 200949580 | Y | | 9/2007 | |
| CN | 200971889 | Y | | 11/2007 | |
| CN | 101194109 | A | | 6/2008 | |
| DE | 2041597 | A1 | * | 8/1971 | ..... F15B 15/222 |
| DE | 102005015091 | A1 | * | 10/2006 | ..... F15B 15/222 |
| JP | 10103311 | A | * | 4/1998 | ..... F15B 15/22 |
| WO | WO 01/90585 | A1 | | 11/2001 | |

* cited by examiner

HYDRAULIC OIL CYLINDER AND RELATED EQUIPMENTS, HYDRAULIC BUFFER SYSTEM, EXCAVATOR AND CONCRETE PUMP TRUCK

The present application claims the benefit of priority to Chinese Patent Application No. 201010235136.2, titled "HYDRAULIC OIL CYLINDER AND RELATED EQUIPMENTS, HYDRAULIC BUFFER SYSTEM, EXCAVATOR AND CONCRETE PUMP TRUCK", filed with the Chinese State Intellectual Property Office on Jul. 23, 2010, the entire disclosure of which is incorporated herein by reference.

FIELD OF THE INVENTION

The present application relates to the field of hydraulic technology, and particularly to a hydraulic oil cylinder. The present application also provides related devices for the hydraulic oil cylinder, and a hydraulic buffer system having the hydraulic oil cylinder, an excavator and a concrete pump truck both having the hydraulic oil cylinder.

BACKGROUND OF THE INVENTION

The hydraulic oil cylinder is a component widely used in the construction machinery, and during the working process of the hydraulic oil cylinder a piston needs to reciprocate continuously. When a piston rod extends to a limiting position, a piston end cap may be impacted strongly by a piston end surface, which may cause damage to the hydraulic oil cylinder. Therefore, a buffer device needs to be provided at that position to avoid the damage to the hydraulic oil cylinder caused by the above impact.

There are great differences among the existing buffer devices according to different applications and different sizes of the hydraulic oil cylinders. A compression spring can be used directly as a buffer device in a small-sized oil cylinder, however, in the hydraulic oil cylinder with a large cylinder diameter and a long stroke, if the compression spring is used as the buffer device, it is hard to obtain a spring having sufficient elasticity, and because that the pressure in the hydraulic oil cylinder is great, the spring will be damaged soon because of being repeatedly compressed. Therefore, the hydraulic oil cylinder with a large cylinder diameter and a long stroke generally use a hydraulic buffer mechanism shown in FIG. 1.

Referring to FIG. 1, the buffer device includes a small buffer ring 06, being mounted in an intermediate annular groove arranged on a piston rod additional section, and a small buffer sleeve 04, being sleeved on the piston rod additional section. Corresponding to the small buffer sleeve 04, a buffer inner hole 07, having an inner diameter cooperating with an outer diameter of the small buffer sleeve 04, is provided at a cover opening portion of a rodless cavity end cover 01 of the oil cylinder. When the piston rod is retracted, the small buffer sleeve 04 is firstly inserted into the buffer inner hole 07 to block an oil-returning oil passage of the rodless cavity in a cylinder barrel 02, and at the same time, a throttling oil channel is formed by a gap between the small buffer sleeve 04 and the buffer inner hole 07; so that, the piston 05 can continue to move in a retracting direction, however due to a buffer effect of the throttling oil channel, the movement speed of the piston 05 is slowed down. And when the piston 05 gradually approaches an end position of the retraction process of the piston rod 03, the throttling oil channel between the small buffer sleeve 04 and the buffer inner hole 07 is gradually increased, which gradually increases the damping effect of the throttling oil channel, thus the movement of the piston 05 is gradually slowed down until eventually reaching the end position of the retraction process of the piston rod 03 smoothly.

Currently, the above buffer mechanism is widely used in the hydraulic oil cylinder with a large cylinder diameter and a long stroke to provide a better buffer protection for the hydraulic oil cylinder.

However, the above buffer mechanism also has some obvious disadvantages. Firstly, for the hydraulic oil cylinder with a large cylinder diameter and a long stroke, such as a driving cylinder used for driving a digging arm of an excavator, the hydraulic oil cylinder is generally working in a working condition of huge load and high frequency. In such a case, the small buffer sleeve 04 in the above buffer mechanism needs to repeatedly insert into the above buffer inner hole 07 at a high speed, and because that the fitting interspace between the small buffer sleeve 04 and the buffer inner hole 07 is very small and the piston rod 03 is very heavy, the piston rod 03 is easy to be tilted to one side under the action of gravity. Therefore in the above hydraulic oil cylinder, failures of the buffer mechanism that the buffer sleeve 04 fails to insert into the buffer inner hole 07 are very easy to happen, which may cause the entire hydraulic oil cylinder being not able to operate normally.

Another key problem of the above buffer mechanism is that, the outer diameter of the small buffer sleeve 04 must fit with the inner diameter of the buffer inner hole 07 precisely, otherwise the buffer effect may not be achieved, thus the buffer mechanism has an extremely high manufacturing precision requirement which is hard to meet for manufacturers with ordinary manufacturing level. Due to the excessive high manufacturing precision requirements, the hydraulic oil cylinder with a large cylinder diameter and a long stroke has become a bottleneck problem for producing construction machineries such as excavators, which severely restricts the production capacity of the manufacturers in downstream production chain.

SUMMARY OF THE INVENTION

The present application provides a hydraulic oil cylinder, and a buffer system of the hydraulic oil cylinder may realize a buffer effect reliably in an operating condition of large load and high frequency and has a longer service life. The manufacturing precision requirement for the hydraulic oil cylinder is low, thereby facilitating the production of the hydraulic oil cylinder. The hydraulic oil cylinder particularly facilitates the manufacturing of the hydraulic oil cylinder having a large cylinder diameter and a long stroke.

The present application also provides devices related to the hydraulic oil cylinder, including a piston rod, a buffer sleeve, and a piston rod additional section.

The present application also provides a hydraulic buffer system having the hydraulic oil cylinder.

The present application also provides an excavator having the hydraulic oil cylinder.

The present application also provides a concrete pump truck having the hydraulic oil cylinder.

The present application provides a hydraulic oil cylinder, wherein a buffer sleeve is axially slidably sleeved on a piston rod additional section located in a rodless cavity, and an end surface of the buffer sleeve facing a bottom of a cylinder barrel is a first end surface of the buffer sleeve; a rodless cavity sealing end surface is provided in an oil cylinder cavity between a rodless cavity oil-passing hole and an end position of a rodless cavity end surface of the piston in a retraction movement of the piston rod, and is configured to block the buffer sleeve and to abut against the first end surface of the buffer sleeve so as to form a sealing surface; and at least one throttling oil channel is further provided, such that during the retraction movement process of the piston rod, the hydraulic oil at a side of the sealing surface close to the piston can flow towards the rodless cavity oil-passing hole through the throttling oil channel in a period from a time when the first end surface of the buffer sleeve abuts against the rodless cavity sealing end surface to form the sealing surface to a time when the piston is retracted to an end position of the retraction movement.

Preferably, the at least one throttling oil channel is provided axially and linearly between the piston rod and the buffer sleeve.

Preferably, an end of the throttling oil channel close to the piston is a first end, the other end of the throttling oil channel close to the rodless cavity oil-passing hole is a second end, and a cross-sectional area of the throttling oil channel is increased gradually from the first end to the second end.

Preferably, in the case that the piston rod is retracted to an end position, there is a distance between the buffer sleeve and an end point of the sliding movement of the buffer sleeve towards the piston.

Preferably, in the case that the first end surface of the buffer sleeve contacts the rodless cavity sealing end surface to form the sealing surface, an area of an axial action, applied on the buffer sleeve by the hydraulic oil at a side of the sealing surface close to the piston, is greater than an area of an axial action, applied on the buffer sleeve by the hydraulic oil at the other side of the sealing surface close to the rodless cavity oil-passing hole.

Preferably, an elastic member, having elasticity and mounted in the rodless cavity, presses the buffer sleeve against a stop shoulder portion provided on a tail end of the piston rod additional section.

Preferably, the stop shoulder portion on the tail end of the piston rod additional section is of a retaining key structure having two semicircular keys.

Preferably, a piston stop shoulder is provided at the end position of the retraction movement of the piston rod, for allowing the buffer sleeve to pass through and stopping the piston at the end position.

Preferably, a main body of the throttling oil channel is a throttling groove arranged axially on a surface of the piston rod additional section.

Preferably, a cross-sectional area of the throttling groove is gradually increased from a first end close to the piston to a second end close to the rodless cavity oil-passing hole, and in the case of a constant width, the cross-sectional area is increased by increasing a depth of the throttling groove.

Preferably, a main body of the throttling oil channel is a throttling groove arranged axially on a surface of the piston rod additional section, and a cross-sectional area of the throttling groove is gradually increased from a first end close to the piston to a second end close to the rodless cavity oil-passing hole. An end surface, close to the piston, of the retaining key is provided with an annular groove, and an outlet of the throttling groove is communicated with the annular groove.

Preferably, one or more annular grooves functioning as balancing grooves are provided in the piston rod additional section, or on an inner diameter surface of the buffer sleeve, and a cross section of the annular groove is V-shaped, U-shaped, square or other forms.

Preferably, the throttling oil channel includes two sections, a front section close to a first end is a throttling groove axially provided on a surface of the piston rod additional section, a rear section close to a second end is a hidden oil channel extending axially in the piston rod additional section, and the throttling groove has a depth gradually increasing from the first end to the second end.

Preferably, the throttling oil channel includes a hidden oil channel extending axially in the piston rod additional section and a plurality of throttling oil holes communicating a surface of the piston rod additional section with the hidden oil channel, the throttling oil holes are axially distributed on the surface of the piston rod additional section, and the closer the throttling oil hole is to a second end of the throttling oil channel, the larger the hole diameter of the throttling oil hole is; and an outlet of the hidden oil channel is a second end of the throttling oil channel, and the throttling oil holes are the first end of the throttling oil channel.

Preferably, the throttling oil channel is a chamfered surface axially arranged on a surface of the piston rod additional section and inclined from an end surface of the piston to a tail end of the piston rod additional section.

Preferably, the rodless cavity sealing end surface is provided on a rodless cavity end cover.

The present application also provides a hydraulic oil cylinder related device, in particular a piston rod, wherein the piston rod includes an additional section located at a rodless cavity and provided with at least one throttling oil channel extending axially, a first end of the throttling oil channel is an end close to a position where a rodless cavity end surface of a piston is located after the piston is mounted; a second end of the throttling oil channel is the other end located at a position where a first end surface of a buffer sleeve is located when the buffer sleeve is not blocked, or is located at a position closer to a tail end of the additional section; and the tail end of the additional section is provided with a stop shoulder portion.

Preferably, the throttling oil channel is a throttling groove arranged on a surface of the piston rod additional section and extended axially and linearly, and a cross-sectional area of the throttling groove is increased gradually from the first end to the second end.

Preferably, an outer diameter surface of the piston rod additional section is provided with a plurality of annular grooves functioning as balancing grooves.

The present application also provides another hydraulic oil cylinder related device, in particular a buffer sleeve, wherein the buffer sleeve has an outer diameter smaller than an inner diameter of a cylinder barrel of the hydraulic oil cylinder in operation, an inner diameter of the buffer sleeve is configured to enable the buffer sleeve to be sleeved on a piston rod buffer position and to slide freely in an axial direction; upon assembling, a first end surface, away from the piston, of the buffer sleeve is configured to abut against a rodless cavity sealing end surface, located between a rodless cavity oil-passing hole and an end position of a retraction movement of a rodless cavity end surface of the piston in an oil cylinder cavity, so as to form a sealing surface.

Preferably, a second end surface of the buffer sleeve corresponding to a sealing end surface of the buffer sleeve is provided with a central protruding portion cooperating with a compression spring.

The present application provides a hydraulic oil cylinder related device, in particular a piston rod additional section, a front portion of the piston rod additional section is provided with a head portion having an external thread for cooperating with a threaded hole provided at an end surface of a tail end of a piston rod body; and a tail end of the piston rod additional section is provided with a retaining key structure. A body of the piston rod additional section is provided with a throttling oil channel, one end of the throttling oil channel is close to a position where a rodless cavity end surface of the piston is located after the piston is mounted, and the other end of the throttling oil channel is located at a position where a sealing end surface of the buffer sleeve is located when the buffer sleeve is not blocked, or is located at a position closer to the tail end of the piston rod additional section.

Preferably, the throttling oil channel is a throttling groove arranged on a surface of the piston rod additional section and extended axially, and a cross-sectional area of the throttling groove is increased gradually from a first end to a second end.

The present application provides a hydraulic buffer system including the hydraulic oil cylinder described in any one of the above technical solutions.

The present application also provides an excavator including at least one hydraulic oil cylinder described in any one of the above technical solutions.

The present application also provides a concrete pump truck including at least one hydraulic oil cylinder described in any one of the above technical solutions.

In the hydraulic oil cylinder provided by the present application, when the piston rod retracts to a position where the buffer process needs to start, the first end surface of the buffer sleeve cooperates with the rodless cavity sealing end surface arranged in the rodless cavity to form a sealing surface so as to block the oil passage. The rodless cavity is divided into two cavity bodies by the sealing surface, a cavity body located at a side of the sealing surface close to the piston is referred to as a buffer oil cavity, and the other cavity body is located at a side of the sealing surface close to the rodless cavity oil-passing hole. The hydraulic oil in the buffer oil cavity being pushed by the piston has a higher oil pressure and may press the first end surface of the buffer sleeve against the rodless cavity sealing end surface tightly, such that the sealing effect of the sealing surface, formed by the first end surface of the buffer sleeve and the rodless cavity sealing end surface abutted together, is more reliable. The oil cylinder is further provided with a throttling oil channel, and the throttling oil channel may provide an oil passage for the hydraulic oil in the buffer oil cavity to flow to a side of the rodless cavity oil-passing hole in a period from the sealing surface is formed to the piston reaches the end position of the retraction movement. Due to the formed sealing surface, which blocks the oil passage, the hydraulic oil can flow, only through the throttling oil channel, towards the rodless cavity oil-passing hole, and the oil passage of the throttling oil channel is very narrow, thus a passing capability of the hydraulic oil is restricted, such that the movement of the piston is subjected to a great resistance, thereby realizing the buffer effect.

In a preferred embodiment of the present application, the above throttling oil channel is arranged axially and linearly between the piston rod additional section and the buffer sleeve, the first end of the throttling oil channel is located in the rodless cavity at a position close to the rodless cavity end surface of the piston, an outlet of the throttling oil channel is located at any position between the first end surface of the buffer sleeve and a bottom end of the rodless cavity, and the position of the outlet of the throttling oil channel is still in the cylinder barrel when the piston rod is retracted to the end point. Due to the above arrangements, the throttling oil channel can be formed after the sealing surface is formed, thereby avoiding the piston being blocked.

In a further preferred embodiment, a main body of the throttling oil channel is a throttling groove arranged axially on the surface of the piston rod additional section, and a cross-sectional area of the throttling groove is gradually increased from the first end to the outlet. In this way, as the piston moves to the end position of the retraction movement, a position of the buffer sleeve relative to the piston rod gradually approaches the first end of the throttling oil channel, thus the discharging capacity from a side of the sealing surface close to the buffer oil cavity to the other side of the sealing surface close to the rodless cavity oil-passing hole is gradually reduced, the resistance for the retraction movement of the piston is gradually increased, and the speed of the piston is gradually reduced, thereby achieving a good buffer effect. Due to the throttling grooves arranged axially and linearly, in the case of a constant width, the throttling effect can be well controlled by controlling the depth variation of the throttling groove, thereby realizing a smooth buffer process.

In a further preferred embodiment of the present application, in the case that the throttling groove is provided, a plurality of annular grooves functioning as balancing oil grooves are provided on the outer diameter surface of the piston rod additional section or the inner diameter surface of the buffer sleeve, and the balancing oil grooves can cooperate with the throttling groove, such that the hydraulic oil may distributed evenly on the inner diameter surface of the buffer sleeve, which ensures that the first end surface of the buffer sleeve will not be tilted when abutting against the rodless cavity sealing end surface, thereby ensuring the tightness of the sealing surface.

In another preferred embodiment of the present application, the following condition has to be satisfied: when the first end surface of the buffer sleeve contacts with the rodless cavity sealing end surface to form the sealing surface, an area of an axial action, applied on the buffer sleeve by the hydraulic oil at a side of the sealing surface close to the piston, is greater than an area of an axial action, applied on the buffer sleeve by the hydraulic oil at the other side of the sealing surface close to the rodless cavity oil-passing hole. The above condition is easy to be satisfied by designing the two end surfaces of the buffer sleeve. If the above condition is not satisfied, the oil pressure at two sides of the sealing surface are substantially same at the moment when the sealing surface is formed, and when the first end surface of the buffer sleeve is pressed towards the rodless cavity sealing end surface at a certain speed, the first end surface of the buffer sleeve may not be pressed tightly against the rodless cavity sealing end surface at the above moment, which may affect the smoothness of the buffer process at that time point. If the above condition is satisfied, a total pressure V1 is obtained by multiplying the oil pressure at the side of the sealing surface close to the piston by the area of the axial action applied on the buffer sleeve at the same side, and a total pressure V2 is obtained by multiplying the oil pressure at the other side of the sealing surface close to the rodless cavity oil-passing hole by the area of the buffer sleeve at the other side. Because the oil pressure at two sides of the sealing surface are substantially same at the moment when the sealing surface is formed, a total pressure at a side having a larger area is relatively large, i.e. V1>V2, thus in this way, the buffer sleeve can be tightly pressed against the rodless cavity sealing end surface, thereby ensuring the smoothness of the buffer process.

Other preferred embodiments of the present application also provide throttling oil channels in other forms, which also can achieve a good discharging effect.

The present application also provides a plurality of parts for the hydraulic oil cylinder, for example a piston rod, a big buffer sleeve and a piston rod additional section, and these parts are all designed specifically to realize the above buffer mechanism.

The present application also provides a hydraulic buffer system having the above hydraulic oil cylinder, and the hydraulic buffer system having the above hydraulic oil cylinder can achieve a good and stable buffer effect.

The present application also provides an excavator and a concrete pump truck both having the above hydraulic oil cylinder, and by using the above hydraulic oil cylinder, the excavator and the concrete pump truck can obtain a longer trouble-free service time.

DETAILED DESCRIPTION OF THE INVENTION

The first embodiment of the present application provides a hydraulic oil cylinder with a buffer device provided in a rodless cavity side of the hydraulic oil cylinder.

Figure 1:
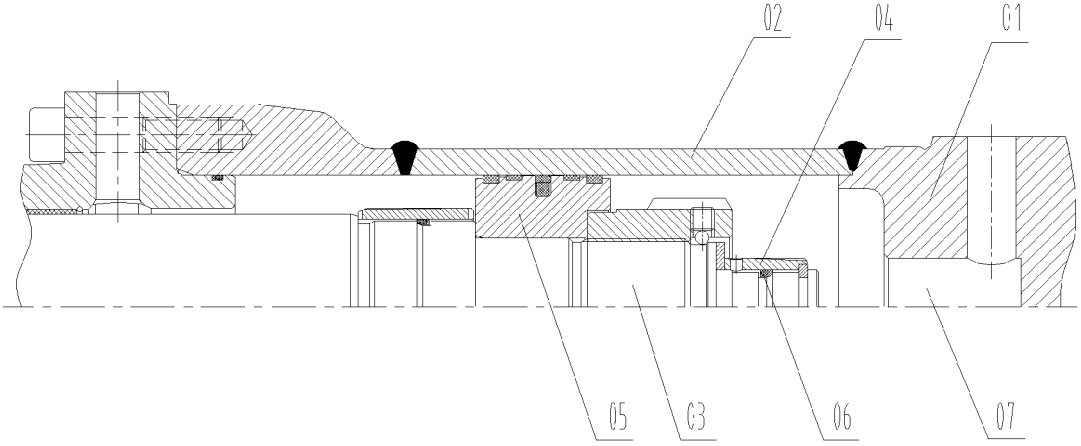
FIG. 1 is the hydraulic oil cylinder in the background having a buffer mechanism in which a buffer sleeve is inserted into a buffer inner hole.
Figure 2:
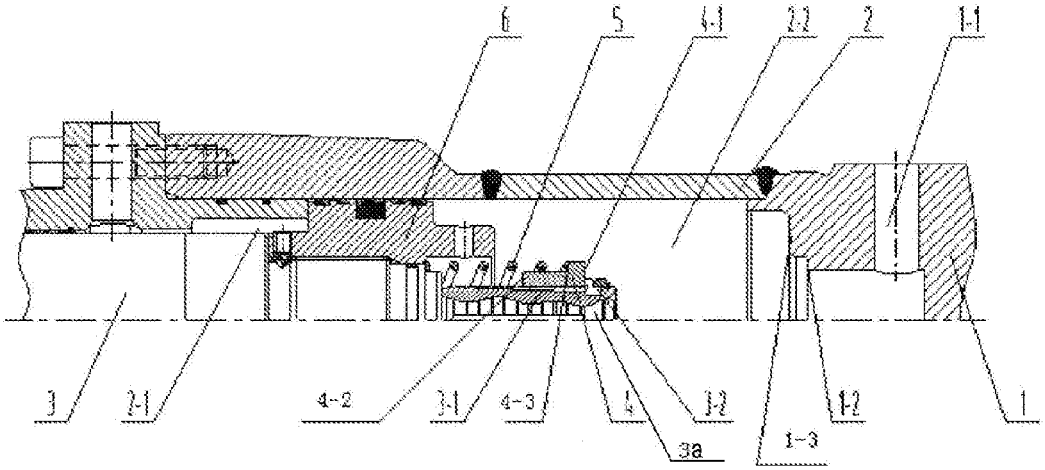
FIG. 2 is a mechanical structural view of a hydraulic oil cylinder according to a first embodiment of the present application, wherein a piston has not yet retracted to a buffer position in a rodless cavity.

Referring to FIG. 2, FIG. 2 is a mechanical structural view of the hydraulic oil cylinder according to the first embodiment of the present application, wherein the piston has not yet retracted to the buffer position in the rodless cavity.

As shown in FIG. 2, the hydraulic oil cylinder includes a rodless cavity end cover 1, a cylinder barrel 2, a piston rod 3, a buffer sleeve 4, a spring 5 and a piston 6.

The cylinder barrel 2 provides a space for sealing the hydraulic oil to the hydraulic oil cylinder, an inner cavity of the cylinder barrel 2 is divided into a rod cavity 2-1 and a rodless cavity 2-2 by the piston 6 which is movable axially along a cavity body of the inner cavity, and a cavity body at which a main body of the piston rod 3 is located is the rod cavity 2-1. An outer diameter surface of the piston 6 cooperates with an inner diameter surface of the cylinder barrel 2 and multiple sealing rings are provided on the outer diameter surface so as to completely isolate the hydraulic oil in the rod cavity 2-1 from the hydraulic oil in the rodless cavity 2-2. In order to mount the buffer device of the rodless cavity, the piston rod 3 is further provided with a piston rod additional section 3*a* located at the rodless cavity side and integrally connected with the piston rod 3, specifically, an external thread on a head portion of the piston rod additional section 3*a* cooperates with a threaded hole on an end surface of a rear end of the main body of the piston rod 3 so as to integrally connect the piston rod additional section 3*a* with the piston rod 3. Of course, the piston rod additional section 3*a* can also be made integrally with the main body of the piston rod 3.

The cylinder barrel 2 is sealed by an end head, located at a side of the rodless cavity 2-2 of the cylinder barrel 2, of the rodless cavity end cover 1, and a rodless cavity oil-passing hole 1-1 is provided on the rodless cavity end cover 1 and is connected to an oil tube so as to provide a passage for the hydraulic oil in the whole inner cavity of the cylinder barrel 2 to flow into or out of the rodless cavity 2-2. A passage for the hydraulic oil to flow into or out of the rod cavity 2-1 is provided by a rod cavity oil-passing hole provided on an end cover of the cylinder barrel 2. This embodiment only describes the buffer device at the rodless cavity side and does not involve the situation at a side of the rod cavity 2-1.

A buffer mechanism of the hydraulic oil cylinder includes the buffer sleeve 4, the spring 5, and structures provided on the piston 6, the piston rod 3 and the rodless cavity end cover 1 for forming the buffer mechanism.

The buffer sleeve 4 is sleeved on the piston rod additional section 3*a*, located in the rodless cavity 2-2, of the piston rod 3. The piston rod additional section 3*a* is a section added to a tail end of the body of the piston rod 3 for placing the buffer structure, and said section is located in the rodless cavity of the piston. A stop shoulder portion 3-2 is provided on a tail end of the piston rod additional section 3*a* such that the buffer sleeve 4 will not slide off of the piston rod additional section 3*a*. An inner diameter of the buffer sleeve 4 is configured in a way which enables the buffer sleeve 4 to slide axially along the piston rod 3 and meanwhile keeps a small gap between the buffer sleeve 4 and the piston rod 3; and an outer diameter of the buffer sleeve 4 is significantly smaller than an inner diameter of the cylinder barrel 2. An end surface of the buffer sleeve 4, facing a bottom end of the hydraulic oil cylinder, i.e. a side surface at a side of the rodless cavity end cover 1, is a plane having a chamfered outer edge, and the plane is referred to as a first end surface 4-1 of the buffer sleeve. The other end of the buffer sleeve 4 is referred to as a second end surface 4-2 of the buffer sleeve, and a protruding portion 4-3 for fixing the spring 5 is further provided on the buffer sleeve 4.

The spring 5 is a compression spring having compression tension and is surroundingly provided on the piston rod additional section 3*a*, a bottom end of the spring 5 abuts against an end surface, at the side of the rodless cavity 2-2, of the piston 6, and a spring protruding portion for fixing the spring is provided on the above end surface of the piston 6. A rear end of the spring 5 abuts against the protruding portion 4-3 of the buffer sleeve 4. By resting against the end surface of the piston 6, the spring 5 may abut against the buffer sleeve 4 with its elastic force, such that the first end surface 4-1 of the buffer sleeve 4 may abut against the stop shoulder portion 3-2 of the piston rod additional section 3*a* when the piston rod 3 is not retracted to a buffer position. The elastic force of the spring 5 is configured in a way, as long as it is enough for making the buffer sleeve 4 abut against the stop shoulder portion 3-2 when the buffer sleeve 4 is not blocked, i.e. the spring 5 provides a reset function.

The rodless cavity oil-passing hole 1-1 and a rodless cavity sealing end surface 1-2 are sequentially provided on the rodless cavity end cover 1 from a cover top to a cover opening. The rodless cavity sealing end surface 1-2 is a stepped surface having an integral annular shape provided in an inner cavity of the rodless cavity end cover 1, and the stepped surface is facing the piston 6. When the piston rod 3 is retracted to a position where the buffer process needs to start, the rodless cavity sealing end surface 1-2 can cooperate with the first end surface 4-1 of the buffer sleeve so as to form a sealing surface for separating the hydraulic oil in the rodless cavity 2-2. A cover opening portion of the rodless cavity end cover 1 is closely contacted with an inner wall surface of the cylinder barrel, and a diameter of the buffer sleeve 4 is smaller than an inner diameter of the cover opening portion such that during the retracting process the buffer sleeve 4 can pass through the cover opening portion while the piston 6 is blocked by an end surface of the cover opening, therefore, the cover opening of the rodless cavity end cover 1 is further provided with a piston stop shoulder 1-3 for limiting an end point of the movement of the piston 6.

Figure 3:
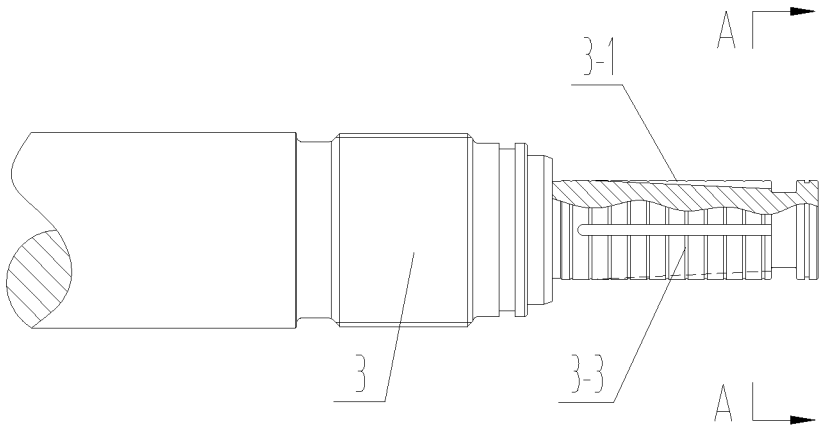
FIG. 3 is a part drawing of a piston rod in the first embodiment of the present application.
Figure 4:
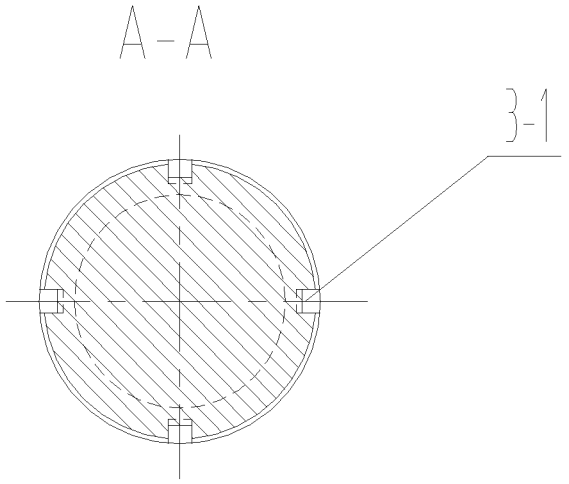
FIG. 4 is a view of the piston rod taken along the line A-A of FIG. 3.

The piston rod additional section 3 is provided with a plurality of structures related to the buffer mechanism, and except for the stop shoulder portion 3-2, throttling grooves, balancing oil grooves and other structures are further provided, which will be described in detail hereinafter. Referring to FIG. 3, FIG. 3 is a part drawing of the piston rod 3; and Referring to FIG. 4, which is a view of the piston rod additional section 3*a* taken along the line A-A.

The piston rod 3 is provided with at least one throttling oil channel, and a main body of the throttling oil channel is a throttling groove 3-1 located on an outer diameter surface of the piston rod 3 and extending axially. The throttling groove 3-1 is provided on the piston rod, a starting point (or referred to as a first end) of the throttling groove 3-1 is located at a position close to a rodless cavity end surface of the piston, and an end point (or referred to as a second end) of the throttling groove 3-1 reaches a sidewall of a retaining key groove provided on the stop shoulder portion 3-2 at the tail end of the piston rod additional section 3*a* for mounting the retaining key. Relative to the end point, the first end is located at the position close to the rodless cavity end surface of the piston; and in fact, the first end of the throttling groove 3-1 needs to cooperate with an end position of the retracting movement of the piston rod 3, such that there is an appropriate hydraulic buffer capability before the piston rod 3 retracts to the end position. In the present embodiment, the first end has been covered completely by the buffer sleeve 4 before the piston rod 3 retracts to the end position.

The stop shoulder portion 3-2 for locating the buffer sleeve is provided on the tail end of the piston rod 3 and includes a retaining key 3-2-1, a retaining key cap 3-2-2, and a retaining ring 3-2-3. The retaining key 3-2-1 is of a two semi-circular rings structure and has an L-shaped cross section, one side of the L-shape of the retaining key 3-2-1 is clamped in a corresponding retaining key groove at the tail end of the piston rod additional section 3*a*, and the other side of the L-shape of the retaining key 3-2-1 faces the piston. An annular groove 3-2-4 is provided on the other side facing the piston at a position where the annular groove 3-2-4 may cooperate with the second end of the throttling groove 3-1. The retaining key cap 3-2-2 has an annular shape and is mounted at a position of the retaining key groove mounted with the retaining key 3-2-1 so as to fix the retaining key 3-2-1. The retaining ring 3-2-3 is embedded in a retaining ring groove at a distal end so as to locate the retaining key cap 3-2-2. The structure of the stop shoulder portion may be used as a universal clamping structure for other occasions. An annular groove 3-2-4, corresponding to the second end of the throttling groove 3-1, is provided on the retaining key 3-2-1, and as can be seen from FIG. 4, a position of the annular groove 3-2-4 is precisely aligned with an outlet of the throttling groove 3-1. Because of the retaining key 3-2-1 is divided into an upper piece and a lower piece, the hydraulic oil flowing from the throttling groove 3-1 into annular groove 3-2-4 may flow out through a gap between the upper piece and the lower piece of the retaining key 3-2-1, therefore, the annular groove 3-2-4 provides an outlet passage for the hydraulic oil flowing out from the outlet of the throttling groove 3-1, especially provides an outlet for the hydraulic oil at the moment when the first end surface 4-1 of the buffer sleeve abuts against the rodless cavity sealing end surface 1-2, thereby avoiding the situation that a resistance hydraulic damping is suddenly increased and ensuring the smooth operation.

A plurality of annular grooves, which are referred to as balancing oil grooves 3-3, are uniformly distributed on the circumferential surface of the piston rod additional section 3. The cross sections of the balancing oil grooves 3-3 may be V-shaped, U-shaped or square or other forms, which are determined according to the requirement, and a depth of the balancing oil grooves 3-3 may also be determined by experiments according to the requirement. The balancing oil grooves 3-3 are provided to realize a circumferential oil-pressure balance when the hydraulic oil flows through the throttling groove 3-1, thereby avoiding an untight sealing of the sealing surface during the buffer process caused by the buffer sleeve 4 being tilted under an unbalanced oil pressure.

Figure 5:
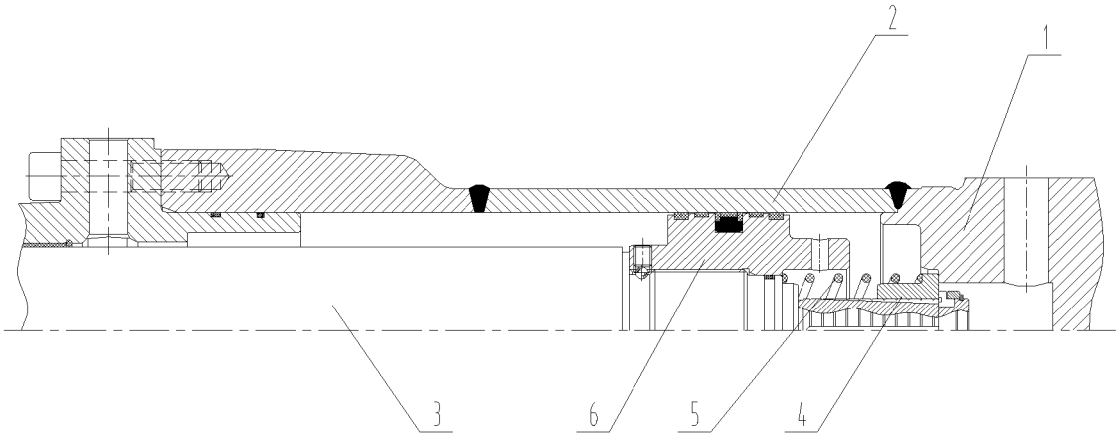
FIG. 5 shows the hydraulic oil cylinder, in a state when a sealing surface starts to form, according to the first embodiment of the present application.

The operation process of the buffer mechanism of the hydraulic oil cylinder according to the present embodiment will be illustrated hereinafter. FIG. 2 shows a state when the piston 6 has not yet reached to the buffer position; referring to FIG. 5, a state when the buffer process is beginning is showed; and referring to FIG. 6, a state when the buffer process is finished is showed.

At the position shown in FIG. 2, the piston rod 3 has just begun the retraction movement and not yet reached the position where the buffer process needs to start. At this time, under the action of the elastic force of the spring 5, the first end surface 4-1 of the buffer sleeve 4 abuts against the stop shoulder portion 3-2 on the tail end of the piston rod additional section 3*a*. And the buffer sleeve 4 is pressed against the stop shoulder portion 3-2 during the period before the piston 6 moves to the buffer position, and the period after the first end surface 4-1 of the buffer sleeve 4 is separated from the rodless cavity sealing end surface 1-2 by the retraction movement of the piston rod 3, therefore, the spring 5 provides a reset function. Along with the retraction movement of the piston rod 3, the hydraulic oil in the rodless cavity 2-2 is pushed by the piston to flow towards the rodless cavity oil-passing hole 1-1 and flow out from the rodless cavity oil-passing hole 1-1. The buffer sleeve 4 moves along with the piston 6 and the piston rod 3 and after moving a certain distance may pass through the cover opening portion of the rodless cavity end cover 1, and because the outer diameter of the buffer sleeve 4 is smaller than the cover opening portion, the buffer sleeve 4 will not be blocked and may continue to move along with the piston rod 3.

After the buffer sleeve 4 passes through the cover opening portion, the first end surface 4-1 of the buffer sleeve 4 will abut against the rodless cavity sealing end surface 1-2 on the rodless cavity end cover 1 soon. When moving to the position shown in FIG. 5, the first end surface 4-1 of the buffer sleeve 4 abuts against the rodless cavity sealing end surface 1-2 on the rodless cavity end cover 1 so as to form an integral sealing surface, such that the passage of the hydraulic oil, pushed by the piston 6, in the rodless cavity 2 flowing towards the rodless cavity oil-passing hole is blocked, and being blocked by the rodless cavity sealing end surface 1-2, the buffer sleeve 4 stops moving forward along with the piston rod 3.

The oil pressure at two sides of the sealing surface are substantially same at the moment when the sealing surface is formed, and when the first end surface 4-1 of the buffer sleeve 4 is pressed towards the rodless cavity sealing end surface 1-2 at a certain speed, the first end surface 4-1 of the buffer sleeve 4 may not be pressed tightly against the rodless cavity sealing end surface 1-2 at the above moment, which may affect the smoothness of the buffer process at that time point. For solving the above problem, the following condition is satisfied in design: when the first end surface 4-1 of the buffer sleeve 4 contacts with the rodless cavity sealing end surface 1-2 to form the sealing surface, an area of an axial action, applied on the buffer sleeve by the hydraulic oil at a side of the sealing surface close to the piston, is greater than an area of an axial action, applied on the buffer sleeve by the hydraulic oil at the other side of the sealing surface close to the rodless cavity oil-passing hole. In this embodiment, areas of two end surfaces of the buffer sleeve 4 are same, however, after the sealing surface is formed, the first end surface 4-1 is partially shielded, thereby satisfying the above condition. After the above condition is satisfied, a total pressure V1 is obtained by multiplying the oil pressure at the side of the sealing surface close to the piston by the area of the axial action applied on the buffer sleeve at the same side, and a total pressure V2 is obtained by multiplying the oil pressure at the other side of the sealing surface close to the rodless cavity oil-passing hole by the area of the buffer sleeve at the other side. Because the oil pressure at two sides of the sealing surface are substantially same at the moment when the sealing surface is formed, a total pressure at a side having a larger area is relatively large, i.e. V1>V2, thus in this way, the buffer sleeve can be tightly pressed against the rodless cavity sealing end surface 1-2, thereby ensuring the smoothness of the process of forming the sealing surface.

After the sealing surface is formed, the buffer sleeve 4 and the rodless cavity end cover 1 form a one-way valve, thereby blocking the oil passage. At this point, the hydraulic oil in the rodless cavity is divided into two cavity bodies, and one cavity body at a side close to the piston 3 is referred to as a buffer oil cavity T. The hydraulic oil in the buffer oil cavity T is pushed by the piston 6, and a main passage of the hydraulic oil flowing towards the rodless cavity oil-passing hole is restricted by the formed sealing surface, thus the pressure of the buffer oil cavity is further increased, and the increased oil pressure is enough to press the buffer sleeve 4 against the rodless cavity sealing end surface 1-2 tightly, which makes the sealing surface more reliable.

At this time, the hydraulic oil can flow, only through the throttling groove 3-1, towards the side of the sealing surface having the rodless cavity oil-passing hole. During an initial stage of the formation of the sealing surface, a depth of the throttling groove 3-1 at the outlet side is relatively larger, such that the flow capability of the throttling groove 3-1 is relatively higher and more hydraulic oil may flow through the throttling groove 3-1. As the piston rod 3 continues to move, the sealing surface moves backward relative to the piston rod additional section 3*a*, such that the depth of the throttling groove 3 communicating two sides of the sealing surface with each other is gradually reduced, which gradually reduces the flow capability of the throttling groove 3. During the above process, when flowing through the throttling groove 3-1, the hydraulic oil flows through the balancing oil grooves 3-3 and fills a rod section at where the buffer sleeve 4 is located, such that the oil pressure on the buffer sleeve 4 at various positions in the circumferential direction are balanced which ensures that the buffer sleeve 4 will not be tilted, thereby ensuring the sealing effect of the sealing surface.

Figure 6:
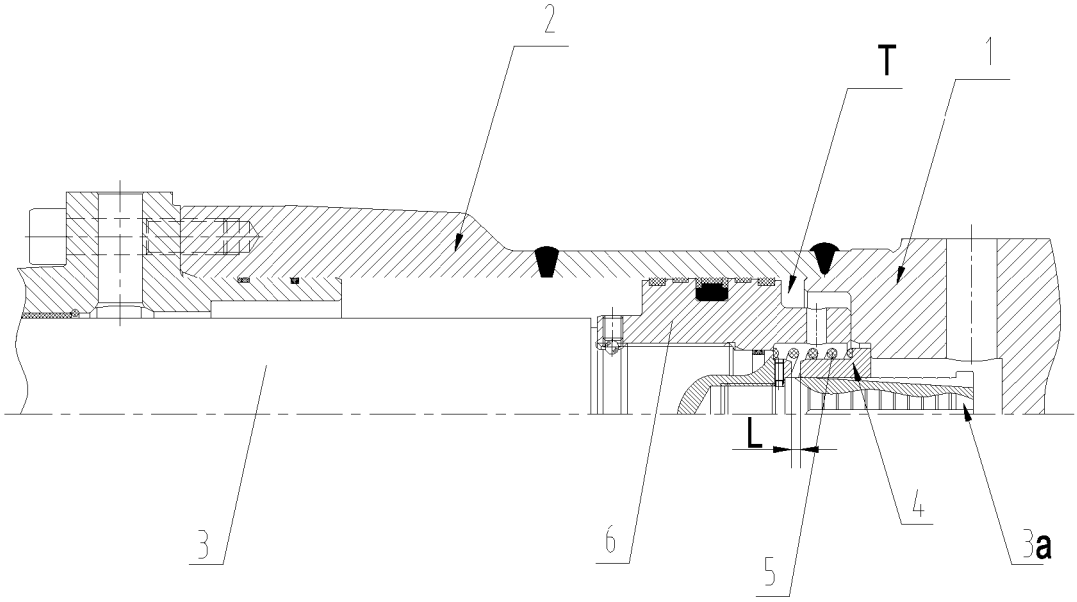
FIG. 6 shows the hydraulic oil cylinder, in a state when the piston moves to an end position, according to the first embodiment of the present application.

After reaching the position shown in FIG. 6, the piston 6 is blocked by the piston stop shoulder 1-3 formed at the end surface of the cover opening of the rodless cavity end cover 1, thus can not move forward. The piston rod 3 reaches the end position of the retraction process, and at this time, the first end of the throttling groove 3-1 has already entered into the buffer sleeve 4, thus the throttling oil channel is substantially blocked and the buffer process is finished. It should be noted that, for making the oil flow into the rodless cavity quickly, when the piston rod 3 retracts to the end position of the retraction stroke, the buffer sleeve 4 has not reached its end position and can still slide towards the piston 6 for a certain distance L. When the piston rod 3 extends, oil flows into the rodless cavity oil-passing hole 1-1, and under the action of the pressure oil, the buffer sleeve 4 is pushed to slide towards the piston 6 and compress the return spring 5, then the first end surface 4-1 of the buffer sleeve 4 is separated from the rodless cavity sealing end surface 1-2 of the rodless cavity end cover 1, such that the rodless cavity oil-passing hole 1-1 is directly communicated with the rodless cavity, and the hydraulic oil enters into the rodless cavity and pushes the piston 6 to move. During the extending process of the piston rod 3, the buffer sleeve 4 and the rodless cavity end cover 1 cooperate with each other to function as a one-way valve. The distance L is provided between the buffer sleeve 4 and the end point of its sliding movement towards the piston 6. The greater the distance L, the larger the separation distance between the first end surface 4-1 of the buffer sleeve 4 and the rodless cavity sealing end surface 1-2 of the rodless cavity end cover 1, and the more the flow quantity of the hydraulic oil flowing into the rodless cavity. The smaller the distance L, the smaller the separation distance between the first end surface 4-1 of the buffer sleeve 4 and the rodless cavity sealing end surface 1-2 of the rodless cavity end cover 1, and the fewer the flow quantity of the hydraulic oil flowing into the rodless cavity.

In fact, due to a gap provided between the buffer sleeve 4 and the piston rod 3, a few amount of hydraulic oil can also enter into the throttling groove 3-1 through the above gap to be discharged, thus in this way, when the first end of the throttling groove 3-1 is shielded completely by the buffer sleeve 4, the piston 6 will not be stuck due to excessive hydraulic oil stored in the buffer oil cavity. Of course, the first end of the throttling groove 3-1 can also be exposed out of the buffer sleeve 4 when the piston rod 3 reaches the end position of the retraction process. The position of the first end of the throttling groove 3-1 and the positional relationship thereof with the buffer sleeve 4 can be designed according to the buffer damping needs.

During the buffer process, the damping effect of the hydraulic oil begins to increase when the sealing surface is formed; specifically, along with the changing of the depth of the throttling groove 3-1, the throttling capability is gradually increased and the hydraulic damping is gradually increased, such that the speed of the piston 6, before reaching the end position, is gradually reduced. At the final short distance, the throttling oil channel can be formed only by the gap between the buffer sleeve 4 and the piston rod additional section 3. During the whole buffer process, the hydraulic damping is gradually increased, thereby avoiding the impact on the rodless cavity end cover 1 and the cylinder barrel 2.

In the above buffer mechanism, under the premise that a width of the throttling groove 3-1 is not changed, a changing curve of the throttling capability of the throttling groove 3-1 can be controlled by controlling the changing of the depth of the throttling groove 3-1, thereby ensuring the piston 6 having a very smooth buffer process.

In fact, instead of being provided on the piton rod 3, the balancing oil grooves may also be provided on an inner diameter surface of the buffer sleeve 4, which may have the same effect as being provided on the piston rod 3. In addition, instead of being annular groove, the balancing oil grooves 3-3 can also be thread groove, however, the annular groove used in the present embodiment is preferable, because it is easy to process and has a better balancing effect.

In the above embodiments, the passages, communicating the cavity bodies at two sides of the sealing surface with each other after the sealing surface is formed, are all referred to as the throttling oil channel, and in the above embodiments, the main body of the throttling oil channel is the throttling groove, however, the composition of the throttling oil channel is different at different times. At the moment when the sealing surface is formed, the annular groove 3-2-4, provided on the retaining key 3-2-1 and corresponding to the throttling groove, functions as the outlet of the throttling passage and has an important effect for realizing the smoothness of the buffer process. If the throttling groove is shielded completely by the buffer sleeve when the buffer sleeve 4 slides to its end position of the buffer process, the gap between the buffer sleeve 4 and the piston rod 3 also constitutes a part of the throttling oil channel.

In the above embodiments, the outlet of the throttling oil channel is provided on the side wall of the retaining key groove, and actually, the outlet of the throttling oil channel can also be provided at a position more close to the tail end, for example on the end surface of the tail end of the piston rod additional section.

In the above embodiments, the sealing surface, formed by the rodless cavity sealing end surface abutting against the first end surface of the buffer sleeve, is a surface contacting sealing surface, and actually, a corresponding design can be performed to the rodless cavity sealing end surface and the first end surface of the buffer sleeve, such that the formed sealing surface may be a planar sealing structure, a conical sealing structure, a curved surface sealing structure, or other surface sealing structures, or any one of linear sealing structures.

Although in the above embodiments, the main body of the throttling oil channel is the throttling groove provided on the surface of the piston rod additional section 3*a*, actually, the throttling oil channel can also use other structural forms.

For example, the throttling oil channel can include two sections, a front section close to the first end is a throttling groove axially provided on the surface of the piston rod additional section, a rear section close to the outlet is a hidden oil channel extending axially in the piston rod additional section, and the above way can also have the throttling effect. The section of the throttling groove can also be designed in this way that the depth thereof is gradually increased from the first end to the outlet so as to achieve the smooth buffer effect.

In another way, the throttling oil channel includes a hidden oil channel extending axially in the buffer sleeve and a plurality of throttling oil holes communicating the surface of the piston rod additional section with the hidden oil channel, the throttling oil holes are axially distributed on the surface of the piston rod, and the closer the throttling oil hole is to the tail end, the larger the hole diameter of the throttling oil hole is. In this way, as the buffer sleeve slides on the piston rod, the piston rod 3 gradually approaches the end position of the retraction process, thus the discharging capacity is gradually reduced and the hydraulic damping effect is gradually increased, which gradually slows down the speed of the piston, thereby achieving a relatively smooth buffer process.

Figure 7:
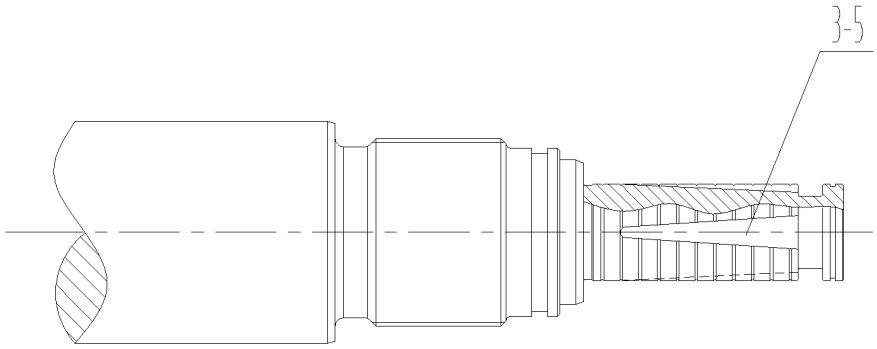
FIG. 7 is a part drawing of the piston rod, where a throttling oil channel is of a chamfered surface structure.
Figure 8:
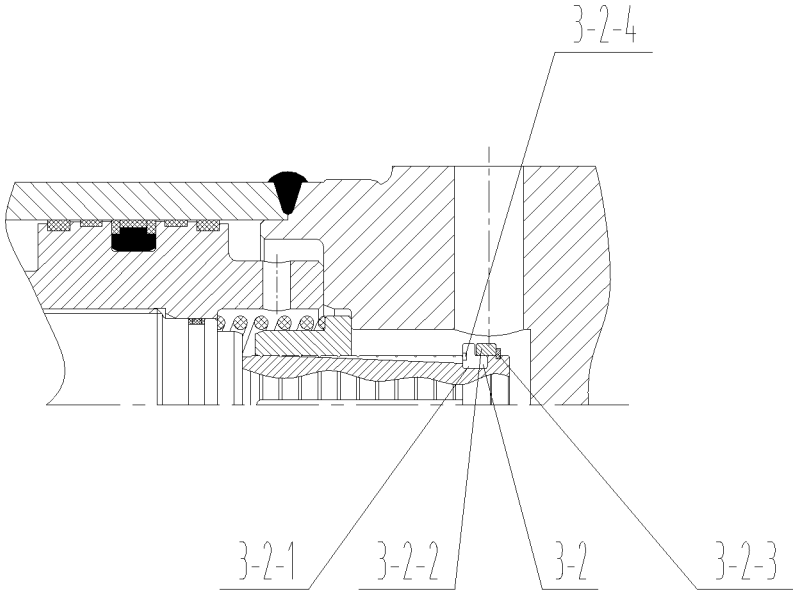
FIG. 8 is a structural view of a retaining key on a tail end of a piston rod additional section.

The throttling oil channel can also be a chamfered surface 3-5 axially arranged on the surface of the piston rod additional section 3*a* as shown in FIG. 7. The chamfered surface 3-5 is inclined from a portion close to the piston to the stop shoulder portion 3-2, and one or more chamfered surfaces can be arranged. In this way, the hydraulic oil can flows out through the chamfered surface 3-5 after the sealing surface is formed by the first end surface 4-1 of the buffer sleeve 4 and the rodless cavity sealing end surface 1-2 on the rodless cavity end cover 1, thereby forming the throttling oil channel. By using the chamfered surface 3-5 to form the throttling oil channel, it can also ensure that when the piston rod 3 gradually approaches the end position of the retraction process, the discharging capability is gradually reduced and the effect of the hydraulic damping is gradually increased, which gradually slows down the speed of the piston, thereby achieving a relatively smooth buffer process.

An embodiment of a hydraulic buffer system of the present application may be achieved by using the hydraulic oil cylinder according to the present application to replace the existing oil cylinder in a hydraulic buffer system.

An embodiment of an excavator of the present application may be achieved by using the hydraulic oil cylinder according to the present application in an excavator.

An embodiment of the concrete pump truck of the present application may be achieved by using the hydraulic oil cylinder according to the present application in a concrete pump truck. The hydraulic oil cylinder according to the present application may also be used in other types of construction machinery.

The present application is illustrated by the above disclosed preferred embodiments; however, the preferred embodiments are not intended to limit the present application. For the person skilled in the art, many variations and modifications may be made to the present application without departing from the spirit or scope of the present application, and the protection scope of the present application is defined by the claims.

The invention claimed is:

1. A hydraulic oil cylinder, wherein a buffer sleeve is axially slidably sleeved on a piston rod additional section located in a rodless cavity, and an end surface of the buffer sleeve facing a bottom of a cylinder barrel is a first end surface of the buffer sleeve;

a rodless cavity sealing end surface is provided in an oil cylinder cavity between a rodless cavity oil-passing hole and an end position of a rodless cavity end surface of a piston in a retraction movement of a piston rod, and is configured to block the buffer sleeve and to abut against the first end surface of the buffer sleeve so as to form a sealing surface; and at least one throttling oil channel is further provided, such that during the retraction movement of the piston rod, the hydraulic oil at a side of the sealing surface close to the piston can flow towards the rodless cavity oil-passing hole through the throttling oil channel in a period from a time when the first end surface of the buffer sleeve abuts against the rodless cavity sealing end surface to form the sealing surface to a time when the piston is retracted to an end position of the retraction movement;

wherein an elastic member, having elasticity and mounted in the rodless cavity, presses the buffer sleeve against a stop shoulder portion provided on a tail end of the piston rod additional section;

wherein the stop shoulder portion provided on the tail end of the piston rod additional section is a retaining key having two semicircular keys; and wherein an end surface of the retaining key close to the piston is provided with an annular groove, and an outlet of the throttling oil channel is communicated with the annular groove.

2. The hydraulic oil cylinder according to claim 1, wherein the at least one throttling oil channel is provided axially and linearly between a surface of the piston rod additional section and the buffer sleeve; and/or an end of the throttling oil channel close to the piston is a first end, the other end of the throttling oil channel close to the rodless cavity oil-passing hole is a second end, and a cross-sectional area of the throttling oil channel is increased gradually from the first end to the second end; and/or when the piston rod is retracted to an end position of the retraction stroke of the piston rod, the buffer sleeve has not reached an end point of the sliding movement of the buffer sleeve towards the piston and can still slide towards the piston for a certain distance L.

3. The hydraulic oil cylinder according to claim 1, wherein when the first end surface of the buffer sleeve contacts the rodless cavity sealing end surface to form the sealing surface, a first pressure, applied on the buffer sleeve by the hydraulic oil at a side of the sealing surface close to the piston, is greater than a second pressure, applied on the buffer sleeve by the hydraulic oil at another side of the sealing surface close to the rodless cavity oil-passing hole.

4. The hydraulic oil cylinder according to claim 1, wherein the retaining key has an L-shaped cross section, one side of the L-shape is clamped in a retaining key groove located at the tail end of the piston rod additional section, and the other side of the L-shape faces the piston.

5. The hydraulic oil cylinder according to claim 4, further comprising a retaining key cap and a retaining ring, wherein the retaining key cap is of an annular shape and is surroundingly provided at a position of the retaining key groove mounted with the retaining key so as to fix the retaining key, and the retaining ring is embedded in a retaining ring groove of the stop shoulder portion so as to locate the retaining key cap.

6. The hydraulic oil cylinder according to claim 1, wherein a piston stop shoulder is provided at an end position of the retraction movement of the piston, for allowing the buffer sleeve to pass through and stopping the piston at the end position.

7. The hydraulic oil cylinder according to claim 1, wherein a main body of the throttling oil channel is a throttling groove arranged axially on a surface of the piston rod additional section.

8. The hydraulic oil cylinder according to claim 7, wherein a cross-sectional area of the throttling groove is gradually increased from a first end close to the piston to a second end close to the rodless cavity oil-passing hole, and in the case of a constant width, the cross-sectional area is increased by increasing a depth of the throttling groove.

9. The hydraulic oil cylinder according to claim 1, wherein one or more annular grooves functioning as balancing grooves are provided in the piston rod additional section, or on an inner diameter surface of the buffer sleeve, and a cross section of the annular groove is V-shaped, U-shaped, square or other forms.

10. The hydraulic oil cylinder according to claim 1, wherein the throttling oil channel comprises two sections, a front section close to a first end is a throttling groove axially provided on a surface of the piston rod additional section, a rear section close to a second end is a hidden oil channel extending axially in the piston rod additional section, and the throttling groove has a depth gradually increasing from the first end to the second end.

11. The hydraulic oil cylinder according to claim 1, wherein the throttling oil channel is a chamfered surface axially arranged on a surface of the piston rod additional section and inclined from an end surface of the piston to a tail end of the piston rod additional section.

12. The hydraulic oil cylinder according to claim 1, wherein the rodless cavity sealing end surface is provided on a rodless cavity end cover.

13. A hydraulic buffer system, comprising a hydraulic oil cylinder, wherein a buffer sleeve is axially slidably sleeved on a piston rod additional section located in a rodless cavity, and an end surface of the buffer sleeve facing a bottom of a cylinder barrel is a first end surface of the buffer sleeve;

a rodless cavity sealing end surface is provided in an oil cylinder cavity between a rodless cavity oil-passing hole and an end position of a rodless cavity end surface of a piston in a retraction movement of a piston rod, and is configured to block the buffer sleeve and to abut against the first end surface of the buffer sleeve so as to form a sealing surface; and at least one throttling oil channel is further provided, such that during the retraction movement of the piston rod, the hydraulic oil at a side of the sealing surface close to the piston can flow towards the rodless cavity oil-passing hole through the throttling oil channel in a period from a time when the first end surface of the buffer sleeve abuts against the rodless cavity sealing end surface to form the sealing surface to a time when the piston is retracted to an end position of the retraction movement;

wherein an elastic member, having elasticity and mounted in the rodless cavity, presses the buffer sleeve against a stop shoulder portion provided on a tail end of the piston rod additional section;

wherein the stop shoulder portion provided on the tail end of the piston rod additional section is a retaining key having two semicircular keys; and wherein an end surface of the retaining key close to the piston is provided with an annular groove, and an outlet of the throttling oil channel is communicated with the annular groove.

14. An excavator, comprising a hydraulic oil cylinder, wherein a buffer sleeve is axially slidably sleeved on a piston rod additional section located in a rodless cavity, and an end surface of the buffer sleeve facing a bottom of a cylinder barrel is a first end surface of the buffer sleeve;

a rodless cavity sealing end surface is provided in an oil cylinder cavity between a rodless cavity oil-passing hole and an end position of a rodless cavity end surface of a piston in a retraction movement of a piston rod, and is configured to block the buffer sleeve and to abut against the first end surface of the buffer sleeve so as to form a sealing surface; and at least one throttling oil channel is further provided, such that during the retraction movement of the piston rod, the hydraulic oil at a side of the sealing surface close to the piston can flow towards the rodless cavity oil-passing hole through the throttling oil channel in a period from a time when the first end surface of the buffer sleeve abuts against the rodless cavity sealing end surface to form the sealing surface to a time when the piston is retracted to an end position of the retraction movement;

wherein an elastic member, having elasticity and mounted in the rodless cavity, presses the buffer sleeve against a stop shoulder portion provided on a tail end of the piston rod additional section;

wherein the stop shoulder portion provided on the tail end of the piston rod additional section is a retaining key having two semicircular keys; and wherein an end surface of the retaining key close to the piston is provided with an annular groove, and an outlet of the throttling oil channel is communicated with the annular groove.

* * * * *